US005223122A

United States Patent [19]

Katayama

[11] Patent Number: 5,223,122

[45] Date of Patent: Jun. 29, 1993

[54] PRODUCING METHOD OF FRACTIONATED WAX PRODUCTS HAVING DIFFERENT MOLECULAR WEIGHTS FROM SOLID WAX

[75] Inventor: Yoshihisa Katayama, Okayama, Japan

[73] Assignee: Chusei Oil Co., Ltd., Okayama, Japan

[21] Appl. No.: 841,853

[22] Filed: Feb. 26, 1992

Related U.S. Application Data

[63] Continuation of Ser. No. 626,617, Dec. 7, 1990, abandoned.

[30] Foreign Application Priority Data

Apr. 18, 1990 [JP] Japan ..... 2-104235

[51] Int. Cl.[5] ..... C10G 73/00

[52] U.S. Cl. ..... 208/24; 208/20

[58] Field of Search ..... 208/24

[56] References Cited

U.S. PATENT DOCUMENTS

| | | | |
|---|---|---|---|
| 2,568,946 | 9/1951 | Burk | 208/24 |
| 2,626,230 | 1/1953 | Clarke | 208/24 |
| 2,626,231 | 1/1953 | Clarke | 208/24 |
| 2,658,853 | 11/1953 | Clarke | 208/24 |
| 2,689,205 | 9/1954 | Clarke | 208/24 |
| 2,703,305 | 3/1955 | Schaerer | 208/24 |
| 2,723,941 | 11/1955 | Weeks et al. | 208/24 |
| 3,088,907 | 5/1963 | Eldib et al. | 208/24 |
| 3,128,241 | 4/1964 | Podlipnik et al. | 208/24 |
| 3,152,917 | 10/1964 | McCoy | 208/24 |
| 4,482,387 | 11/1984 | Wood et al. | 208/24 |
| 4,548,755 | 10/1985 | Stahl et al. | 208/24 |

*Primary Examiner*—Helane Myers

*Attorney, Agent, or Firm*—Koda and Androlia

[57] ABSTRACT

A producing method of fractionated wax products characterized in that it comprises the steps of preparing as a raw material, solid wax, more particularly, low molecular weight polyolefine wax which is a byproduct when manufacturing polyolefine polymer and which is formed into flakes or pellets whose areas in contact with a solvent are large, bringing the raw material into contact with the solvent for dissolving the raw wax at temperatures lower than a melting point thereof, while increasing the temperature by degrees, and separating a solution containing extracted wax from the raw wax at each temperature so as to remove the solvent from the solution. The resulting wax products have a melting peak point within a range of 40° C. to 130° C., crystal melting heat of 100J/g or more, and a range of melting points of 40° C. to 5° C., when measured by the DSC.

4 Claims, No Drawings

PRODUCING METHOD OF FRACTIONATED WAX PRODUCTS HAVING DIFFERENT MOLECULAR WEIGHTS FROM SOLID WAX

This is a continuation of application Ser. No. 626,617, filed Dec. 7, 1990, now abandoned.

BACKGROUND OF THE INVENTION

1. Industrial Field of the Invention

The present invention relates to a plurality of kinds of wax products fractionated from raw wax in a solid state through solid-liquid extraction so that they have different melting points, a particular temperature range between a melting starting point and a melting ending point, and a specific melting energy, such fractionated wax products being suitable for thermosensitive paper, thermo-sensors, hot-melt adhesives and the like.

2. Description of the Prior Art

In the related field of industry, there is great demand for wax products having different melting points which are fractionated, in accordance with molecular weights, from polyolefine of a low polymerization degree manufactured through Ziegler process, coal synthetic wax, synthetic wax such as Fischer-Tropsch wax, petroleum paraffin wax or natural wax. Recently, wax which has a small range of melting points, i.e., a small range between a melting starting point and a melting ending point and whose melting energy is large is especially in demand so as to be used for thermo-sensors, thermosensitive paper, heat accumulators, hot-melt adhesives and the like.

Wax products made from Ziegler process polyolefine of a low polymerization degree, i.e., polyethylene of a low polymerization degree which is a byproduct when manufacturing polyethylene and polyethylene of a low polymerization degree produced by polymerizing ethylene or polymerizing ethylene as a main component are available at present. However, they do not meet the above-mentioned industrial demand particularly because they are far from satisfactory in respect of the range of melting points.

Conventionally, some kinds of wax products having different melting points have been produced by solvent fractionation of petroleum wax, but they have problems in relation to various desired melting points and a range of the melting points, and also, a producing method thereof is not favorable. For example, a recrystallization method with an organic solvent, a sweat-out method or the like have been suggested. In the organic solvent recrystallization method, it is necessary to use a large amount of the solvent and separate precipitated crystals from a solution through filtration. Since the precipitated wax is in a gel state, filtration cannot be easily performed, and this step of filtration has been an industrial drawback. In the sweat-out method, the procedure involves complication because it requires, for instance, high-temperature long process, and resulting wax has low-grade purity and is limited to certain uses. In the present situations, therefore, there can be observed almost no technique to provide wax Products of various kinds whose melting characteristics satisfy the demand, and there can be found almost no wax products having desired melting points and particular melting characteristics so as to meet the requirements in actual use.

Especially, there has been neglected research for a method of fractionating polyolefine wax of a low polymerization degree which is a byproduct when manufacturing polyolefine such as polyethylene in order to obtain wax products having different molecular weights. Consequently, fractionated wax products having favorable characteristics as described above have not been found out.

The present invention has an object to provide a method of producing one kind or a plurality of kinds of wax products having different melting points, i.e., different average molecular weights, from raw wax such as Ziegler synthetic wax or paraffin wax in a simple manner.

SUMMARY OF THE INVENTION

The inventors of the present application has succeeded in developing a method of fractionating raw wax into wax products having different melting points, i.e., different average molecular weights in such a manner that solid wax, more specifically, solid wax such as Ziegler synthetic wax or paraffin wax as the raw wax is brought into solid-liquid contact with a solvent for dissolving the solid wax at a temperature lower than a melting point thereof, and that a solution is separated to evaporate and remove the solvent therefrom.

According to the method of the present invention, various kinds of wax products having different melting points, i.e., different molecular weights can be easily produced from wax of a multi-component substance having a certain distribution of molecular weights. Especially in the present invention, wax remaining after extraction has a shape close to its original shape so that it can be readily separated from the solution. Besides, since it is not necessary to precipitate wax from the solution, there is required no step of processing precipitated wax in a gel state. In the related art, therefore, the method is remarkably advantageous in simplification of the procedure, reduction of operation time, improvement of quality of resulting products, and the like.

Further, there can be suitably obtained the products which have a melting peak point within a range of 40° C. to 130° C., crystal melting heat of 100J/g or more, and a range between crystal melting starting and ending points as small as 40° C. to 5° C., when measured by a differential scanning calorimeter (DSC). Due to such a small range between melting starting and ending points, high melting latent heat, excellent thermal stability, and excellent chemical stability, the wax products are useful for heat accumulators, thermo-sensors, thermosensitive paper, thermo-transfer ink and hot-melt adhesives.

DETAILED DESCRIPTION OF THE PREFERRED EMBODIMENTS

Ziegler synthetic wax or paraffin wax is preferable for raw wax of the present invention, and such wax is a multi-component substance which has a large distribution of molecular weights. Further, it is necessary to use wax which is in a solid state at least at a temperature when the wax is brought into contact with a solvent which will be described later.

Particularly suitable raw wax is low molecular weight polyethylene mainly composed of ethylene which is a byproduct when manufacturing polyethylene (it is often polymerized with a secondary component such as propylene and butylene) having the carbon number of 5 to 1000 and the peak carbon number of 20 to 200. It is also possible to use other wax of various kinds, e.g., coal wax or its intermediate, synthetic wax or its intermediate such as Fischer-Tropsch wax or its intermediate, petroleum wax or its intermediate such as slack wax and scale wax, natural wax and the like.

Besides, it is possible to use the above kinds of wax for raw wax of the present invention after filtering them to remove the impurities from them or distilling them to evaporate low molecular weight components.

If a mass of wax to be processed is too large or thick, it is difficult to extract required wax components from the original wax. In such a case, it will be necessary, for instance, to lengthen the time of immersing the wax in a solvent. On the other hand, if wax is in too fine powder or in too thin flakes or tablets which will be broken into fine particles during the extraction, the unprocessed solid wax may be mixed in a solution. Further, a metal net or cloth for filtration may be clogged.

Therefore, wax in spherical or pellet-like grains having a diameter of 10 mm or less or wax in flakes or tablets having a thickness of 5 mm or less is, in general, preferably used for raw wax. However, wax in flakes or tablets having a thickness of 0.2 mm or less which will be broken and turned into powder during the extraction, and wax in spherical or pellet-like grains having a diameter of 1 mm or less are not suitable for raw wax because the unprocessed wax will be mixed in a solution and because a metal net or cloth for filtration may be clogged.

Aromatic hydrocarbon such as toluene and xylene, aliphatic ketone such as methyl ethyl ketone and methyl isobutyl ketone, aliphatic hydrocarbon, e.g., n-paraffin and isoparaffin, which is in a liquid state at a temperature equal to or lower than a melting point of raw wax, such as n-hexane and n-octane, light oil fraction and kerosene fraction distilled from petroleum and the like can be suggested as a solvent for dissolving solid-state raw wax of the above-described kinds. Any other solvent can be used if it is capable of extracting wax components from solid wax. However, in respect of dissolution efficiency and operative efficiency of solvent separation after solid-liquid contact, it is preferable to use aromatic hydrocarbon such as toluene and xylene, and ketone such as methyl ethyl ketone and methyl isobutyl ketone. Needless to say, these solvents can be mixed at a proper rate and used as a mixed solvent.

It is an essential matter that when raw wax is brought into solid-liquid contact with a solvent and heated up to an appropriate temperature, the raw wax is in a solid state. Since the raw wax will be dissolved, as it is, into the solvent at a temperature equal to or higher than a melting point of the raw wax itself, it will be impossible to obtain wax products from the original wax.

Any of the following methods for the solid-liquid contact can be employed: raw wax placed in an appropriate vessel is subjected to a heated solvent in a shower; raw wax is immersed in a solvent for a predetermined period of time before the solvent is drained from it; raw wax is immersed in a solvent for a predetermined period of time while the solvent is supplied to and drained from it; or one dose of a solvent in which raw wax is immersed is circulated before the wax is cleaned by another dose of the solvent.

After such a solid-liquid contact operation, a solvent is evaporated and removed, in a commonly used method, from a solution in which a wax component is dissolved, and thus, wax components of different melting points, i.e., of different average molecular weights are fractionated from raw wax.

Further, the evaporated solvent can be collected and repeatedly used for dissolution.

Since solid-state raw wax is brought into solid-liquid contact with a solvent at a temperature lower than a melting point of the whole raw wax, only wax components whose melting points correspond to temperatures of the solvent are extracted from the original wax consisting of a multi-component substance.

The present invention has an advantage that the above-described solid-liquid extraction enables some of the fractionated wax components whose melting points are relatively low, more particularly, whose melting peak points are not more than 40° C. when measured by a differential scanning calorimeter (DSC), to increase the isoparaffin contents. In other words, it enables some of the fractionated wax components whose melting peak points are not less than 40° C. to increase the n-paraffin contents, thereby obtaining fractionated wax components which have large crystal melting energies.

It is a remarkable effectiveness of the present invention in the related industrial field that it can readily provide fractionated wax which has a melting point not less than 40° C. but whose crystal melting energy is large.

Because wax components whose melting points are higher than those of dissolved wax components remain within the solid-state raw wax, separation from the solvent can be conducted quickly and easily in comparison with gel-state wax which is produced in a conventional method that after mixing Ziegler synthetic wax or paraffin wax with a solvent and heating the mixture to dissolve the whole wax, the mixture is cooled down so that wax components are successively precipitated. Especially because a porous pumice-like solid substance which only contains wax components of higher melting points remains after wax components of lower melting points have been extracted, efficiency of the fractional extraction can be further increased.

When raw wax is suitably formed in flakes, tablets, or pellet-like grains for facilitating solvent extraction, dissolution and extraction can be effectively performed in a short period of time. Extraction is conducted by increasing the temperature of the solvent by degrees so as to enable fractional extraction in accordance with molecular weights.

The present invention will be described in detail hereinafter on the basis of the preferred embodiments.

EXAMPLE 1

320 g of Ziegler synthetic wax A in flakes having a thickness of about 2 mm and a melting point of 86° C. was put in a vessel, and 2 l of toluene at a temperature of 10° C. was added to it. After extraction was performed by moderately stirring the mixture for two hours while maintaining it at the same temperature, a toluene solution was separated. This solution is referred to hereinunder as the first solution. Next, 2 l of toluene at a temperature of 20° C. was added to the wax anew, and after stirring the mixture for two hours while maintaining it at the same temperature, a toluene solution was separated. This solution is referred to hereinunder as the second solution. Further, extraction was repeated through substantially the same operations, increasing the temperature by 10° C. from 30° C. to 90° C., thereby obtaining third to ninth solutions.

These solutions were separately distilled to remove the solvent of toluene therefrom, and melting points, average carbon numbers, melting energies, n-paraffin contents and yields of the remaining wax components were measured. The results are shown in Table 1.

TABLE 1

| | RAW WAX | FIRST SOLUTION | SECOND SOLUTION | THIRD SOLUTION | FOURTH SOLUTION | FIFTH SOLUTION |
|---|---|---|---|---|---|---|
| EXTRACTION TEMPERATURE (°C.) | | 10 | 20 | 30 | 40 | 50 |
| MELTING POINT (°C.) | 86.0 | 17.1 | 27.5 | 50.3 | 58.6 | 73.3 |
| AVERAGE CARBON NUMBER | 48.1 | 17.9 | 22.0 | 24.7 | 29.2 | 34.3 |
| MELTING ENERGY (J/g) | 187.01 | 60.63 | 147.5 | 174.45 | 201.29 | 229.18 |
| n-PARAFFIN CONTENT (%) | | 76.16 | 86.24 | 88.65 | 91.26 | 93.12 |
| YIELD (%) | | 12.4 | 2.4 | 5.9 | 9.7 | 14.8 |

| | SIXTH SOLUTION | SEVENTH SOLUTION | EIGHTH SOLUTION | NINTH SOLUTION | REMAINDER |
|---|---|---|---|---|---|
| EXTRACTION TEMPERATURE (°C.) | 60 | 70 | 80 | 90 | |
| MELTING POINT (°C.) | 86.9 | 97.5 | 104.2 | 101.5 | 131.5 |
| AVERAGE CARBON NUMBER | | | | | |
| MELTING ENERGY (J/g) | 225.05 | 231.27 | 229.66 | 216.9 | 203.53 |
| n-PARAFFIN CONTENT (%) | | | | | |
| YIELD (%) | 21.9 | 19.7 | 7.3 | 1.1 | |

Melting Point: Peak Temperature Measured by DSC
Average Carbon Number: Measured by Gas Chromatography
Melting Energy: Measured by DSC
n-Paraffin Content: Measured by Gas Chromatography Table 2 shows distributions of paraffin carbon numbers of the first to fifth solutions which were measured by gas chromatography.

TABLE 2

| PARAFFIN CARBON NUMBER | FIRST SOLUTION | SECOND SOLUTION | THIRD SOLUTION | FOURTH SOLUTION | FIFTH SOLUTION |
|---|---|---|---|---|---|
| 12 | 3.91 | 0.40 | 0.58 | | |
| 14 | 14.06 | 2.84 | 1.42 | 0.29 | 0.24 |
| 16 | 17.43 | 6.09 | 2.43 | 0.66 | 0.32 |
| 18 | 15.72 | 11.18 | 5.03 | 1.43 | 0.69 |
| 20 | 11.33 | 16.40 | 9.62 | 2.86 | 1.19 |
| 22 | 6.61 | 17.20 | 14.28 | 5.43 | 1.87 |
| 24 | 3.47 | 13.22 | 16.02 | 9.30 | 3.09 |
| 26 | 1.73 | 8.5 | 13.78 | 12.60 | 5.24 |
| 28 | 1.02 | 4.98 | 10.05 | 13.86 | 7.85 |
| 30 | 0.48 | 2.71 | 6.56 | 12.78 | 10.02 |
| 32 | 0.24 | 1.38 | 3.96 | 10.27 | 10.85 |
| 34 | 0.12 | 0.68 | 2.30 | 7.50 | 10.44 |
| 36 | 0.04 | 0.34 | 1.31 | 5.39 | 9.20 |
| 38 | | 0.17 | 0.72 | 3.64 | 7.93 |
| 40 | | 0.09 | 0.39 | 2.27 | 6.86 |
| 42 | | 0.05 | 0.19 | 1.37 | 5.91 |
| 44 | | | | 0.81 | 5.00 |
| 46 | | | | 0.50 | 3.71 |
| 48 | | | | 0.30 | 2.71 |

EXAMPLE 2

220 g of Ziegler synthetic wax B in tablets having a thickness of about 3 mm and a melting point of 82.6° C. was put in a cylindrical vessel whose bottom was formed of a fine metal net. After extraction was Performed by circulating 2 l of methyl isobutyl ketone at a temperature of 50° C. for three hours while maintaining it at the temperature of 50° C., a methyl isobutyl ketone solution was separated. This solution is referred to hereinunder as the first solution. Next, after extraction was performed a new by circulating 2 l of methyl isobutyl ketone at a temperature of 60° C., a solution was separated. This solution is referred to hereinunder as the second solution. Further, extraction was repeated through substantially the same operations at temperatures of 70° C. and 80° C., thereby obtaining third and fourth solutions.

These solutions were separately distilled to remove the solvent of methyl isobutyl ketone therefrom, and yields, melting points, etc. of the remaining wax components were measured. The results are shown in Table 3.

TABLE 3

| | RAW WAX | FIRST SOLUTION | SECOND SOLUTION | THIRD SOLUTION | FOURTH SOLUTION |
|---|---|---|---|---|---|
| EXTRACTION TEMPERATURE (°C.) | | 50 | 60 | 70 | 80 |
| MELTING POINT (°C.) | 82.6 | 58.3 | 74.7 | 83.1 | 91.5 |
| AVERAGE CARBON NUMBER | 40.2 | 28.0 | 37.1 | 43.0 | |
| MELTING ENERGY (J/g) | 221.39 | 166.36 | 217.12 | 228.17 | 21.55 |

TABLE 3-continued

| | RAW WAX | FIRST SOLUTION | SECOND SOLUTION | THIRD SOLUTION | FOURTH SOLUTION |
|---|---|---|---|---|---|
| n-PARAFFIN CONTENT (%) | | 74.96 | 86.28 | 89.06 | |
| YIELD (%) | 25.8 | 12.0 | 15.6 | 15.4 | |

EXAMPLE 3

330 g of paraffin wax in flakes having a thickness of about 2 mm and a melting point of 56.7° C. was put in a vessel, and 1 l of methyl ethyl ketone at a temperature of 30° C. was added to it. After extraction was performed by moderately stirring the mixture for one hour while maintaining it at the same temperature, a methyl ethyl ketone solution was separated. This solution is referred to hereinunder as the first solution. Next, 1 l of methyl ethyl ketone at a temperature of 40° C. was added to the wax anew, and after stirring the mixture for one hour while maintaining it at the same temperature, a methyl ethyl ketone solution was separated. This solution is referred to hereinunder as the second solution. Further, extraction was performed through substantially the same operations at a temperature of 50° C., thereby obtaining a third solution.

These solutions were separately distilled to remove the solvent of methyl ethyl ketone therefrom, and melting points, average carbon numbers, yields, etc. of the remaining wax components were measured. The results are shown in Table 4.

TABLE 4

| | RAW WAX | FIRST SOLUTION | SECOND SOLUTION | THIRD SOLUTION | REMAINDER |
|---|---|---|---|---|---|
| EXTRACTION TEMPERATURE (°C.) | | 30 | 40 | 50 | |
| MELTING POINT (°C.) | 56.7 | 49.9 | 53.9 | 59.1 | 63.6 |
| AVERAGE CARBON NUMBER | 26.8 | 24.3 | 26.5 | 28.1 | 30.1 |
| MELTING ENERGY (J/g) | 198.07 | 191.8 | 193.26 | 208.25 | 208.6 |
| n-PARAFFIN CONTENT (%) | 87.26 | 80.47 | 84.41 | 87.55 | 89.59 |
| YIELD (%) | | 14.7 | 31.1 | 45.4 | |

As clearly understood from the above-described embodiments, one kind or a plurality of kinds of product wax having different melting points, i.e., different average molecular weights were easily produced from raw wax.

What is claimed is:

1. A method for producing wax products by fractionating solid wax depending on molecular weights, comprising the steps of:

(a) preparing solid wax as a raw material;

(b) bringing the raw material into solid-liquid contact with a solvent for dissolving a portion of said raw material having a lower molecular weight than the molecular weight of the raw material at a temperature lower than a melting point of the raw material;

(c) separating a solution from the solid state raw material;

(d) evaporating/removing said solvent from the solution so as to obtain a fractionated wax product having a different molecular weight; and (e) repetitively performing steps (b), (c) and (d) while increasing said temperature of said solvent step by step.

2. A producing method according to claim 1, wherein said solid wax as the raw material is polyolefine wax of a low polymerization degree which is a byproduct when manufacturing polyolefine through Ziegler process or petroleum paraffin wax, the raw material being formed in flakes or tablets having a thickness of not more than 5 mm and not less than 0.2 mm or in pellets having a diameter of not more than 10 mm and not less than 1 mm.

3. A producing method according to claim 1, wherein said solvent is aromatic hydrocarbon, aliphatic hydrocarbon, aliphatic ketone or the like, which is in a liquid state at a temperature equal to or lower than the melting point of said wax as the raw material.

4. A method for producing wax products according to claim 2 wherein the solid wax raw material is a polyolefine wax of a low polymerization degree.

* * * * *